US009422131B1

(12) United States Patent
Sadeck

(10) Patent No.: US 9,422,131 B1
(45) Date of Patent: Aug. 23, 2016

(54) QUICK RELEASABLE SEAM

(71) Applicant: The United States of America as Represented by the Secretary of the Army, Washington, DC (US)

(72) Inventor: James E. Sadeck, East Freetown, MA (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 197 days.

(21) Appl. No.: 14/258,077

(22) Filed: Apr. 22, 2014

Related U.S. Application Data

(63) Continuation-in-part of application No. 13/752,486, filed on Jan. 29, 2013, now abandoned.

(51) Int. Cl.
*A43C 1/04* (2006.01)
*B65H 69/04* (2006.01)

(52) U.S. Cl.
CPC ..... *B65H 69/04* (2013.01)

(58) Field of Classification Search
CPC ..... B65H 69/04; A41D 25/08; B65D 33/26; B65D 30/00
USPC ..... 289/1.2, 1.5; 383/66, 107, 79, 92, 4
See application file for complete search history.

(56) References Cited

U.S. PATENT DOCUMENTS

| | | | | | |
|---|---|---|---|---|---|
| 2,495,873 | A * | 1/1950 | Strong | B64D 1/02 | 244/145 |
| 3,030,003 | A * | 4/1962 | Schanzle | B65D 33/26 | 383/37 |
| 3,081,929 | A * | 3/1963 | Williams | B65D 33/26 | 383/79 |
| 3,337,118 | A * | 8/1967 | Friduss | B65D 33/26 | 383/211 |
| 4,623,109 | A | 11/1986 | Sadeck | | |
| 4,955,563 | A | 9/1990 | Lee et al. | | |
| 4,973,090 | A * | 11/1990 | Hyduke | D04G 5/00 | 289/1.2 |
| 5,618,011 | A | 4/1997 | Sadeck et al. | | |
| 5,893,592 | A * | 4/1999 | Schulze | A61B 17/0469 | 289/1.2 |
| 6,328,262 | B1 | 12/2001 | Sadeck et al. | | |
| 6,520,453 | B1 | 2/2003 | Sadeck | | |
| 7,293,742 | B2 | 11/2007 | Sadeck | | |
| 7,416,158 | B2 | 8/2008 | Sadeck | | |

* cited by examiner

*Primary Examiner* — Robert J Sandy
*Assistant Examiner* — Matthew Sullivan
(74) *Attorney, Agent, or Firm* — Roger C. Phillips

(57) ABSTRACT

Apparatuses, systems, and methods for securing/releasing material are provided. For example, in one embodiment of the invention a releasable seam system that includes a first textile material. The first textile material includes a plurality of edges. On at least one of these edges is a first plurality of loops. The system also includes at least one at least one other textile material. Each textile material in the at least one other textile material has at least one edge with a plurality of loops thereon. The plurality of loops on the at least one other textile material and the first plurality of loops are paired to form opposing loop pairs. Thereafter, a locking chord is interwoven through the opposing loop pairs to temporarily secure the first textile material to the at least one other textile material.

4 Claims, 4 Drawing Sheets

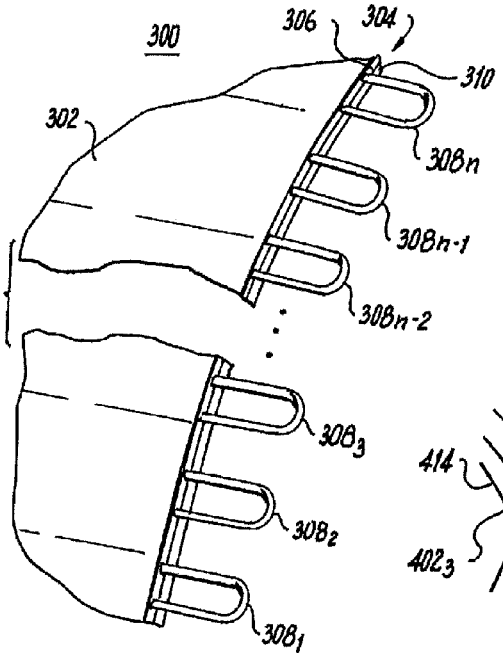
Fig. 3
Fig. 4
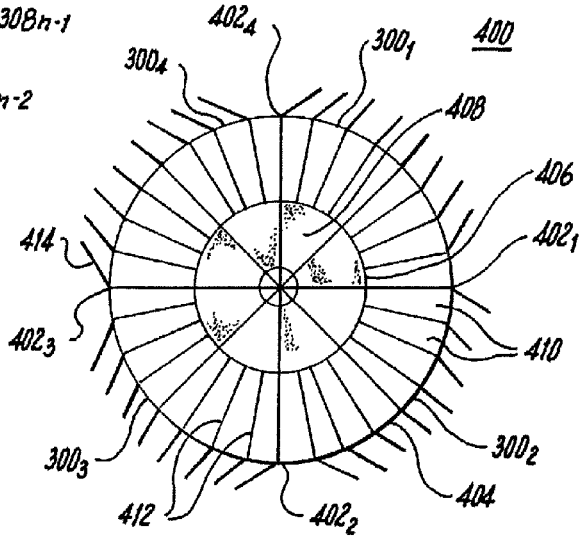
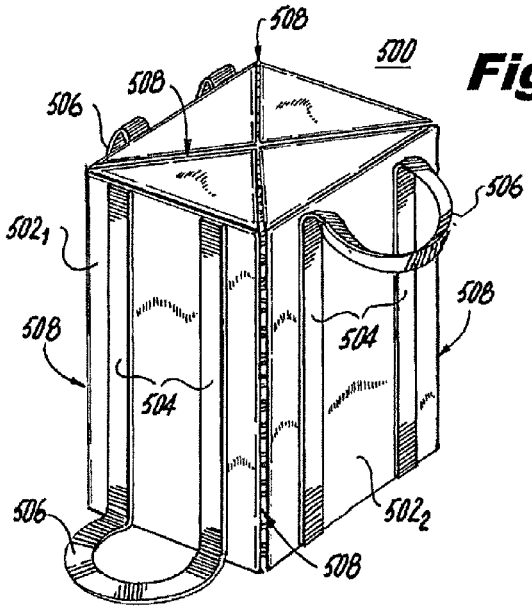
Fig. 5
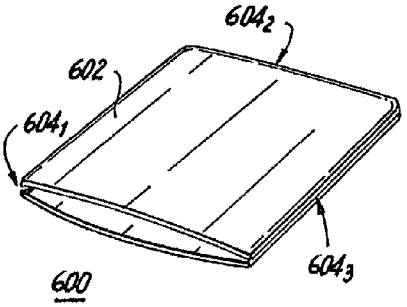
Fig. 6

Fig. 7
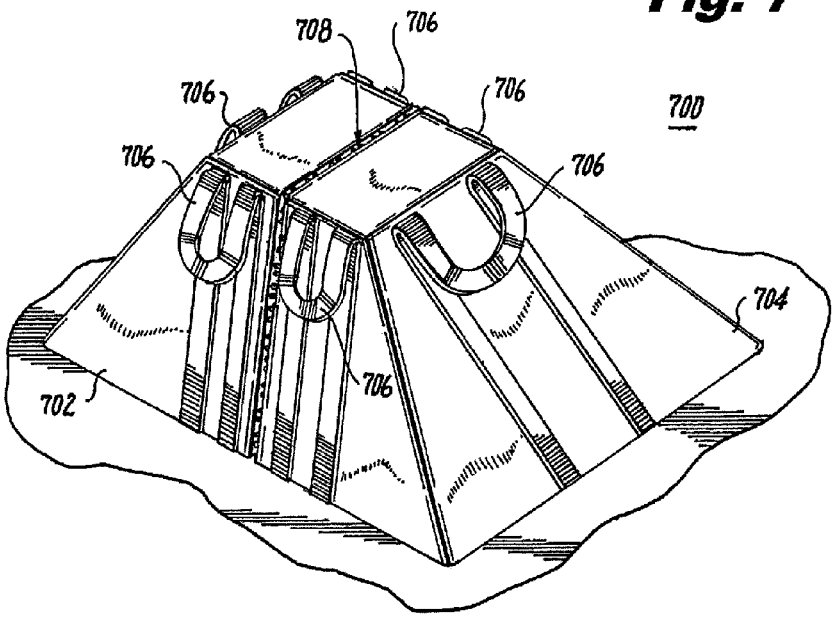
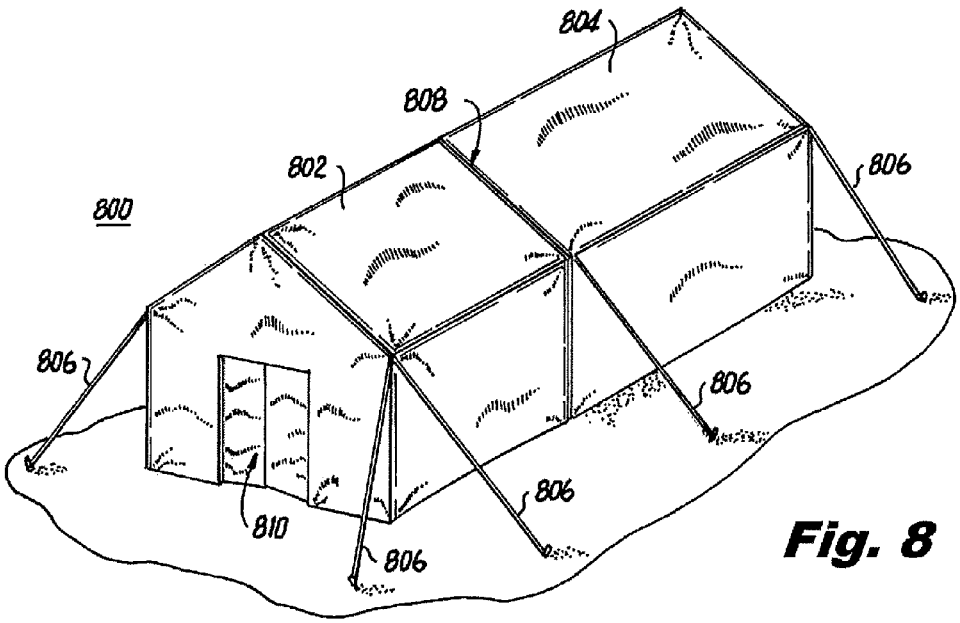
Fig. 8

QUICK RELEASABLE SEAM

BACKGROUND

1. Field of the Invention

Embodiments herein generally relate to apparatuses and methods for securing/releasing material. In particular, the present invention relates to novel apparatuses and methods for securing/releasing an edge of one material to/from an edge of another material.

2. Description of the Related Art

There are instances when textile materials need to be repaired and/or moved. Often these materials are quite heavy. For example, large textile canopy covers such as tents, protective tarps, parachute canopies, receptacles (i.e., bags) that are filled with an item(s), and temporary shelters can be quite massive and heavy when fabricated as one complete item.

Repair and replacement of these items can be expensive. In addition, to have a replacement unit readily available (i.e., in the field for use when needed) is often not an efficient use of available resources (e.g., space).

In addition, some textile materials utilize zippers (i.e., for opening, for closing, and/or connecting materials). However, there are occasions when zippers jam. Further, there are instances when a zipper is difficult to use. For example, when a zipper is used to close a large bag and that bag needs to be opened for deployment of the contents of the bag (e.g., sand).

There is a need in the art for systems, methods, and apparatuses that provides modular repair/replacement of textile materials and easier connection/disconnection.

SUMMARY

Embodiments herein generally relate to apparatuses and methods for securing/releasing material. In particular, the present invention relates to novel apparatuses and methods for securing/releasing an edge of material to/from an edge of another material.

Modular replacement of textile items helps reduce weight, ease construction, reduce cost, and save space. Joining modular pieces of textile items utilizes a connection method that is strong, easily connected, and quickly disconnected in the field. Modular fabrication also simplifies manufacturing and facilitates easier maintenance.

For example, in one embodiment of the invention a releasable seam system that includes a first textile material is provided. The first textile material includes a plurality of edges. On at least one of these edges is a first plurality of loops. The system optionally includes at least one other textile material. Each textile material in the at least one other textile material has at least one edge with a plurality of loops thereon. The plurality of loops on the at least one other textile material and the first plurality of loops are paired to form opposing loop pairs. Thereafter, a locking chord is interwoven through the opposing loop pairs to temporarily secure the first textile material to the at least one other textile material.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIG. 3 depicts a side view of an embodiment of the invention;

FIG. 4 depicts a top view of an embodiment of the invention;

FIG. 5 depicts a perspective view of an exemplary bag in accordance with aspects of the invention;

FIG. 6 depicts a side view of another exemplary bag in accordance with aspects of the invention;

FIG. 7 depicts a perspective view of yet another exemplary bag in accordance with aspects of the invention; and FIG. 8 depicts a perspective view of an exemplary tent in accordance with aspects of the invention.

To facilitate understanding, identical reference numerals have been used, wherever possible, to designate identical elements that are common to the figures.

DETAILED DESCRIPTION

In the following description, numerous specific details are set forth to provide a more thorough understanding of the invention. As will be apparent to those skilled in the art, however, various changes using different configurations may be made without departing from the scope of the invention. In other instances, well-known features have not been described in order to avoid obscuring the invention. Thus, the invention is not considered limited to the particular illustrative embodiments shown in the specification and all such alternate embodiments are intended to be included in the scope of the appended claims.

For example, embodiments of the invention are described herein as being used to join together portions of a parachute. However, these descriptions are not intended in any way to limit the scope of the invention. It is appreciated that aspects of the invention can be incorporated into non-parachute items (e.g., to temporarily secure two edges of a material together, to temporarily secure an edge of one material to an edge of another material, and/or to form a receptacle).

Figure 1:
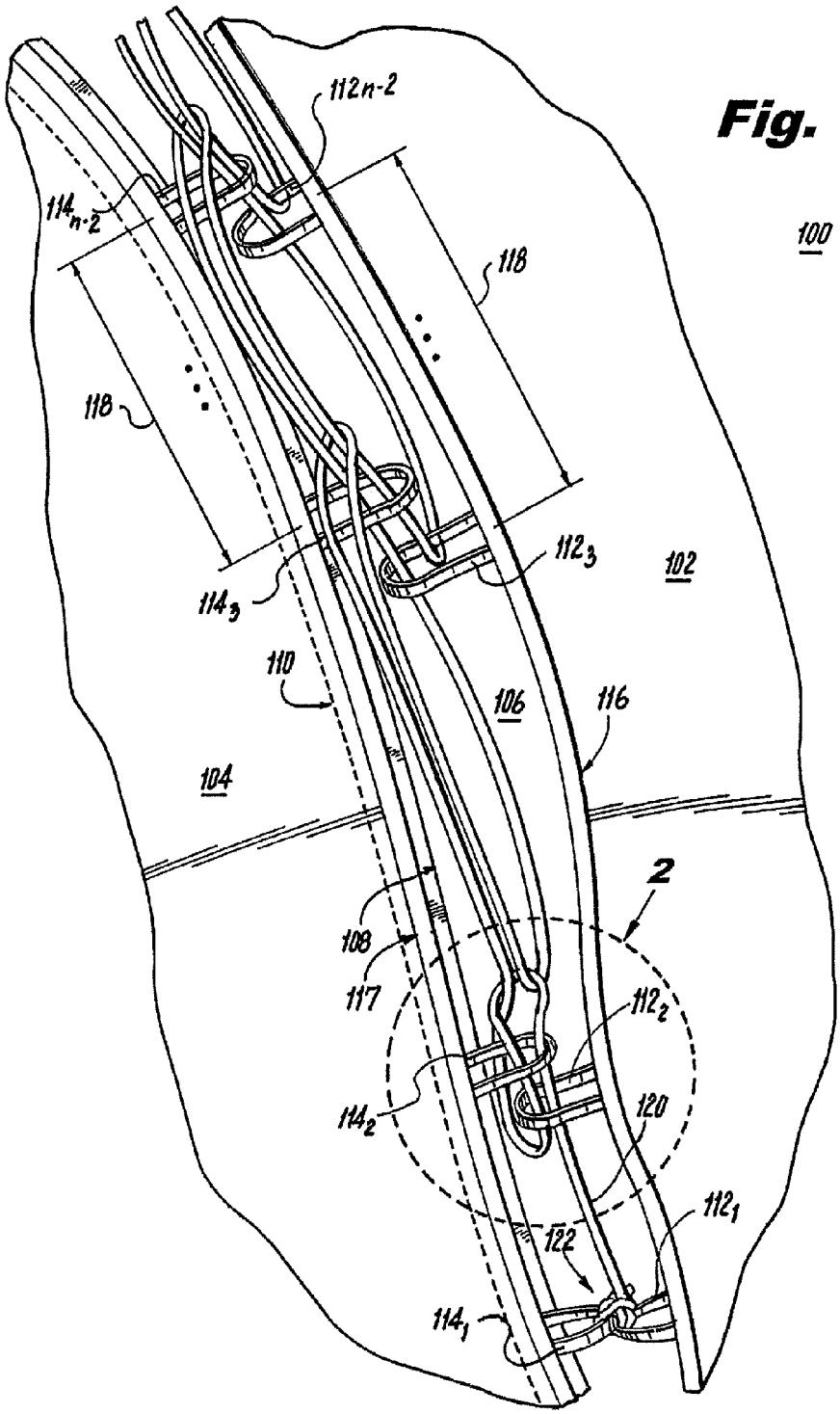
FIG. 1 depicts a perspective view of a system in accordance with aspects of the invention.

FIG. 1 depicts a perspective view of a system 100 in accordance with aspects disclosed herein. The system 100 includes a first textile material 102 and a second textile material 104.

The first textile material 102 has a strip of anchor tape 116 stitched along its peripheral edge. The anchor tape 116 is used to secure a plurality of loops $\mathbf{112}_1$, $\mathbf{112}_2$, $\mathbf{112}_3$, . . . , $\mathbf{112}_{n-2}$, $\mathbf{112}_{n-1}$ (not shown in FIG. 1), and $\mathbf{112}_n$ (not shown in FIG. 1) (collectively "loops 112") to the first textile material 102. The loops 112 are spaced apart (e.g., about 4 inches apart) (the distance between loops 112 is represented by element 118). It is appreciated that the distance between loops 112 can be more than 4 inches in some embodiments of the invention and less than 4 inches in other embodiments of the invention, depending on the application and load requirements.

The first textile material 102 also includes a flap 106 along its periphery. For example, in various embodiments of the invention, the width of the flap 106 is about 1 inch to about 5 inches or more.

The second textile material 104 has a strip of anchor tape 117 stitched along its peripheral edge. The anchor tape 117 is used to secure a plurality of loops 114$_1$, 114$_2$, 114$_3$, . . . , 114$_{n-2}$, 114$_{n-1}$ (not shown in FIGS. 1) and 114$_n$ (not shown in FIG. 1) (collectively "loops 114") to the second textile material 104. The loops 114 are spaced apart (e.g., about 4 inches apart) (the distance between loops 114 is represented by element 118). It is appreciated that the distance between loops 114 can be more than 4 inches in some embodiments of the invention and less than 4 inches in other embodiments of the invention, depending on the application and load requirements. The second textile material 104 also includes an overlapping edge 108.

For illustrative purposes only, the first textile material flap 106 is outstretched. A portion of the second textile material 104 is laid on top of the flap 106 such that loops 112 and loops 114 are adjacent to the flap 106. For each individual loop 112 there is a corresponding loop 114 (also referred to herein as "loop pairs"). Corresponding loops 112 and loops 114 are placed in close proximity to each other. For example, loop 112$_2$ on the first textile material 102 has, in close proximity therewith, a corresponding loop 114$_2$ on the second textile material 104 to form a loop pair.

Overlapping edge 108 is that portion of the second textile material 104 that is on the flap 106 of the first textile material 102.

A locking chord 120 is interwoven/snaked through each loop pair (i.e., a loop 112 and its respective corresponding loop 114). An exemplary manner in which the locking chord 120 is interwoven is depicted in FIG. 1. However, the depicted manner is not intended in any way to limit the scope of the invention. It is appreciated that other weaving patterns can be used in various embodiments of the invention.

Two pairs of loop pairs are used as tie down points to secure the ends of the locking chord 120 to the first textile material 102 and the second textile material 104. In FIG. 1, only one tie down point is visible (i.e., tie down point 122) using loop 112$_1$ and corresponding loop 114$_1$. A knot is used to tie the locking chord 120 to loops 112$_1$ and 114$_1$. Any knot (e.g., at least one Half-hitch knot, a Bowline knot, or a FIG. 8 knot) that has sufficient breaking strength (a greater breaking strength than locking chord 120) can be used at the tie down points.

As explained above, on the first textile material 102 and the second textile material 104 there is a loop 112 and 114, respectively, about every 4 inches. FIG. 1 depicts a loop pair (i.e., loop 112$_{n-2}$ and loop 114$_{n-2}$) that is two loop pairs away from the tie down point not visible in FIG. 1. In other words, two loop pairs (containing loop 112$_{n-1}$ and loop 114$_{n-1}$; and another loop pair (containing loop 112$_n$ and loop 114$_n$) are not visible in FIG. 1. The loop pair containing loop 112$_n$ and loop 114$_n$ is used as the tie down point (and as indicated above, is not visible in FIG. 1).

Figure 2:
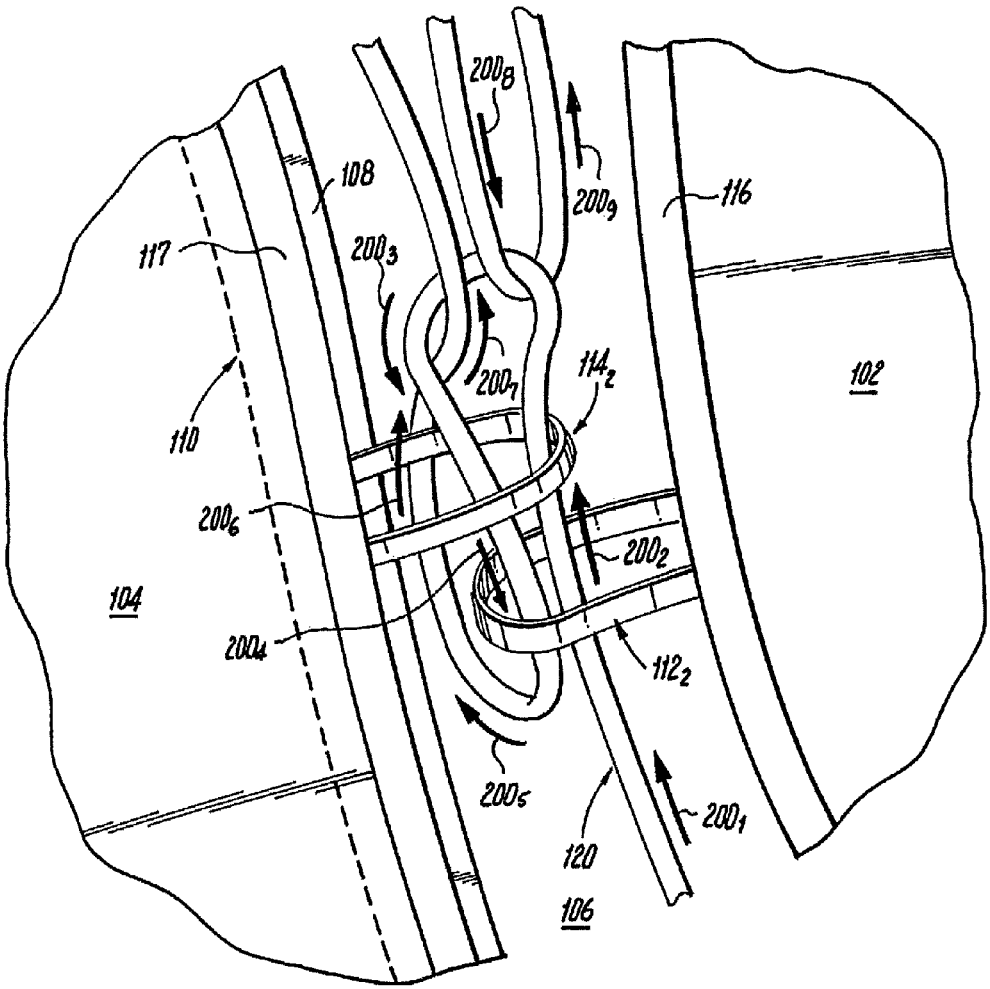
FIG. 2 depicts a close-up perspective view of a portion of the system depicted in FIG. 1.

FIG. 2 depicts a close-up perspective view of a portion of the system 100 depicted in FIG. 1. Specifically, FIG. 2 depicts a close-up view of one loop pair (i.e., loop 112$_2$ and corresponding loop 114$_2$) and an exemplary pattern for interweaving/snaking the locking chord 120 the loop pair.

As shown in FIG. 1, loops 112$_2$ and 114$_2$ are the loops next to the loops (i.e., loop 112$_1$ and 114$_1$) that are used as one of the tie off points 122. Returning to FIG. 2, for illustrative purposes only arrows 200$_1$, 200$_2$, 200$_3$, 200$_4$, 200$_5$, 200$_6$, 200$_7$, 200$_8$, and 200$_9$ (collectively "arrows 200") are included alongside locking chord 120 to show an exemplary interweaving/snaking of the locking chord 120.

In accordance with an aspect of the invention a method of interweaving/snaking the locking chord 120 through loops 112 and 114 is presented. In this aspect of the invention, the locking chord 120 is passed (see arrows 200$_1$ and 200$_2$) through loop 112$_2$ and loop 114$_2$. Thereafter, the locking chord 120 is formed into a locking chord loop (see arrows 200$_2$ and 200$_3$). After formation of the locking chord loop, the locking chord 120 is passed through loop 114$_2$ and 112$_2$ (see arrows 200$_3$ and 200$_4$); and back up (without again passing through loop 112$_2$ and 114$_2$) through the locking chord loop (see arrows 200$_5$, 200$_6$, and 200$_7$).

Thereafter the locking chord 120 is snaked to the next loop pair (i.e., loops 112$_3$ and 114$_3$ in FIG. 1 (not shown in FIG. 2)) (see arrow 200$_7$). Although not shown in FIG. 2, the locking chord 120 is passed near loops 112$_3$ and 114$_3$ to form another locking chord loop and is brought back down towards locking chord loop (formed 200$_3$) (see arrow 200$_8$). The locking chord 120 is passed through locking chord loop (formed at 200$_3$) and back up (see arrow 200$_9$) towards loops 112$_3$ and 114$_3$. The locking chord 120 is then extended up through loops 112$_3$ and 114$_3$ near a further pair of loop pairs 112$_{n-2}$ and 114$_{n-2}$ to form a further locking chord loop and then past back through the loops 112$_3$ and 114$_3$. The locking chord 120 is then passed up through loop pairs 112$_{n-2}$ and 114$_{n-2}$ near loop pairs 112$_{n-1}$ and 114$_{n-1}$ (not shown) to form still a further locking chord loop. This repeats until the last pair of opposed loops 112$_n$ and 114$_n$ where a terminal end of the locking 120 is tied.

The locking chord 120 and loop pairs are kept loose until the locking chord 120 is interwoven/snaked through all of the loop pairs. After the locking chord 120 is interwoven/snaked through all of the loop pairs, the locking chord 120 is pulled tight (to draw the edge of the first textile material 102 and the edge of the second textile material 104 closer together), and the locking chord 120 is tied off at the tie off points 122.

In FIGS. 1 and 2, first textile material 102 depicts flap 106 and second textile material depicts overlapping edge 108 however it is understood that each textile material includes two edges where one edge includes a flap 106 and the other edge includes an overlapping edge 108. In this manner each textile material can either mate an overlapping edge 108 on a textile material with a flap 106 on another textile material; or mate an overlapping edge 108 with a flap 106 on the same textile material.

Although aspects of the invention are described herein as utilizing two textile materials (i.e., a first textile material and a second textile material) those descriptions are not intended to limit the scope of the invention in any way. For example, there are various embodiments of the invention in which there is only one textile material. For example, a bag can be made, from one textile material (e.g., first textile material 102), where the loop pairs (i.e., one edge has loops 112 and the edge has loops 114) are brought together (using loops 112, loops 114, and locking chord 120 interwoven/snaked through loops 112 and loops 114) to form a receptacle. To increase the capacity of the bag, another textile material (e.g., second textile material 104) and locking chord can be added to the system. As the need to increase the capacity of the bag increases, textile materials and locking chords can be added. To remove the contents of the bag, the locking chord(s) can be cut. For example, in an aircraft (or other vehicle), to rapidly deploy a sand filled bag, the locking chord(s) can be cut and pulled through the loop pairs; and the sand dumped from the bag.

Various embodiments of the invention can be used for different textile material constructs (e.g., canopy covers, tents, protective tarps, parachute canopies, receptacles (i.e., bags) for holding an item(s), and temporary shelters.

For illustrative purposes only, aspects of the invention are described herein using a parachute canopy. However, those descriptions are not intended in any way to limit the scope of the invention.

Various configurations of parachute canopies can be used in accordance with the invention. Exemplary parachute canopies that can be adapted for used with the invention are disclosed in U.S. Pat. Nos. 4,623,109; 4,955,563; 5,303,883; 6,328,262; 6,520,453; 7,293,742; and 7,416,158. The current document incorporates by reference all of the material contained in U.S. Pat. Nos. 4,623,109; 4,955,563; 5,303,883; 6,328,262; 6,520,453; 7,293,742; and 7,416,158.

FIG. 3 depicts a side view of an embodiment of the invention. Specifically, FIG. 3 depicts a cross section of an exemplary canopy section 300 in accordance with aspects of the invention. The canopy section 300 includes an upper surface 302. Although canopy section 300 includes two edges, only edge 304 is visible in FIG. 3. Edge 304 includes anchor tape 306; an overlapping edge 310; and loops $\mathbf{308}_1$, $\mathbf{308}_2$, $\mathbf{308}_3$, . . . , $\mathbf{308}_{n-2}$, $\mathbf{308}_{n-1}$, and $\mathbf{308}_n$ (collectively "loops 308").

The edge of canopy section 300 that is not visible in FIG. 3 includes a flap edge, loops, and anchor tape. The edge (that is not shown) is adapted to mate with edges constructed similarly to edge 304.

The number of canopy sections 300 used to construct a canopy depends upon the size of the canopy sections 300 and the size of the canopy. For example, FIG. 4 provides an exemplary canopy that includes 4 sections. The depiction of a canopy that includes four sections is for illustrative purposes and not intended in any way to limit the scope of the invention. It is appreciated that in various embodiments of the invention more than four canopy sections are used and in other embodiments of the invention less than four canopy sections are used.

Returning to FIG. 4, there is shown a view of the top of the parachute canopy 400 having 4 canopy sections 300 (i.e., canopy sections $\mathbf{300}_1$, $\mathbf{300}_2$, $\mathbf{300}_3$, and $\mathbf{300}_4$). The canopy 400 includes a canopy skirt 404 and a vent periphery 406. A vent opening 408 is centrally located and is bounded by the vent periphery 406.

The canopy sections 300 are connected to each other at quick release seams $\mathbf{402}_1$, $\mathbf{402}_2$, $\mathbf{402}_3$, and $\mathbf{402}_4$ (collectively "quick release seams 402"). Illustratively, the quick releasable seams are located at each of the canopy sections 300 includes multiple gore sections 410. In each respective canopy section 300, gore seams 412 connect gore sections 410. Eight gore seams 412 are depicted as continuing on the surface of a net material 416 and connect at area 418.

Attached to the canopy skirt 404 is a plurality of suspension lines 414.

FIGS. 5-8 (described below) depict various exemplary embodiments of bags used in accordance with aspects of the invention. However, these embodiments of the invention are not intended in any way to limit the scope of the invention.

Each of the embodiments depicted in FIGS. 5-8 includes a plurality of textile material sections connected together at seams formed by coupling the edges of a textile material section in the plurality to at least one other textile material section in the plurality.

As described above, in the description of FIGS. 1 and 2, at least one edge of each textile material section includes a strip of anchor tape stitched along a first peripheral edge, a flap, and a first plurality of loops.

Stitched on at least one other edge of each of the textile material sections is a strip of anchor tape. A second plurality of loops and an overlapping edge are on the at least one other stitched edge.

The following description of FIGS. 5-8 do not describe in detail the stitched edges and plurality of loops on the textile material sections. However, it is appreciated that each of the modular seams are formed by interweaving a locking chord through loops located on the edges of the textile material sections, as described above. For brevity, FIGS. 5-8 depicts (and the description below regarding these figures refer to) the modular seams.

For example, FIG. 5 depicts an illustrative bag 500 (e.g., a cargo bag). For illustrative purposes only, the cargo bag 500 is depicted as having four textile material sections (i.e., textile material section $\mathbf{502}_1$, $\mathbf{502}_2$, $\mathbf{502}_3$, $\mathbf{502}_4$ (collectively "textile material sections 502"). However, it is appreciated that various embodiments, of the invention, utilize more or less textile material sections 502. Illustratively, the bag 500 has a substantially rectangular profile.

In FIG. 5, the textile material sections 502 are connected together at modular seams 508. Each textile material section 502 contains a lift strap 504 and lift strap handle 506. In various embodiments of the invention, one pair of lift strap handles 506 are positioned on one end of the bag 500 and another pair of lift strap handles 506 are positioned on an opposite end of the bag 500 to provide greater flexibility in handling the bag 500.

After the bag 500 is formed (by interweaving the locking chords through the loops to form seams) material can be placed in the bag 500. After material is placed inside the bag 500, a portion of the bag 500 which remained open (to allow placement of the material inside the bag 500) can be sealed (by interweaving a locking chord between loops to form another seam). The bag 500 is subsequently re-opened by removing any of the locking chords that connect any two textile material sections 502 to each other.

FIG. 6 depicts an exemplary two-sided bag 600 in accordance with embodiments of the invention. The bag 600 includes two textile material sections 602. Each textile material section 602 has edges $\mathbf{604}_1$, $\mathbf{604}_2$, and $\mathbf{604}_3$ that incorporate the interwoven loops as explained above. Although not shown in FIG. 6, it is appreciated that in various embodiments of the invention utilize different ways of sealing the bag 600. For example, in one embodiment of the invention, the opening of the bag 600 is sealed by interwoven loops located on the textile material sections 602.

FIG. 7 depicts an exemplary bag 700. The exemplary bag 700 is illustratively depicted as an ammunition speed bag 700. The bag 700 includes a first textile material section 702 and a second textile material section 704. Each of the textile material sections 702 and 704 includes a plurality of lift straps 706.

FIG. 8 depicts an embodiment of a combined tent 800 in accordance with aspects of the invention. For illustrative purposes only, combined tent 800 includes tent 802 and tent 804 (hereinafter referred to as "sub-tent 802" and "sub-tent 804," respectively). In various embodiments of the invention, tent 800 includes more than two sub-tents (e.g., three or more sub-tents).

It is appreciated that sub-tent 802 and sub-tent 804 can be used independently of one another. However, there are instances when it is beneficial to join sub-tents (e.g., when one tent has a specific purpose (e.g., food galley), to increase the size of medical tent, or to spread soldiers out over the joined tent so that provisions remain guarded). The sub-tents 802 and 804 are joined along seam 808. The seam 808 operates as explained above.

Sub-tents 802 and 804 each include at least one passageway. In FIG. 8, only passageway 810 is visible. However, sub-tent 802 and sub-tent 804 include additional passageways (not shown) so that when sub-tent 802 and sub-tent 804 are joined access between sub-tent 802 and sub-tent 804 is permitted.

In various embodiments of the invention, more than two sub-tents can be daisy-chained together. For example, sub-tent 804 includes a second passageway so that access can be granted between sub-tent 804 and a third sub-tent (not shown) connected via a seam as explained above). The third sub-tent can likewise be receptive to connection (via a seam as explained above) and access to a fourth sub-tent.

While the foregoing is directed to embodiments of the present invention, other and further embodiments of the invention may be devised without departing from the basic scope thereof, and the scope thereof is determined by the claims that follow.

I claim:

1. A method of interweaving a locking cord for releasable seam system comprising a pair of laterally spaced opposing loops at least one of which being attached to a textile material, the method comprising:

tying one end of the locking chord to a first pair of opposing loops;

passing the locking chord through a second pair of opposing loops;

forming the locking chord into a first locking chord loop;

passing the locking chord back through the second pair of opposing loops and back without again passing through the second pair of opposing loops and instead passing the locking chord through the first locking chord loop;

repeating the following until coming to a terminal pair of opposing loops;

snaking the locking chord near a third pair of opposing loops;

forming the locking chord into a second locking chord loop;

bringing the locking chord back through first locking chord loop and back towards the third pair of opposing loops;

passing the locking chord through the third pair of opposing loops and near a fourth pair of opposing loops;

forming the locking chord into a third locking chord loop;

bringing the locking chord back through the second locking chord loop and back through the third pair of opposing loops;

passing the locking chord through the a fourth pair of opposing loops and near a fifth pair of opposing loops;

keeping the locking chord and all loop pairs loose until the locking chord is interwoven/snaked through all of the loop pairs;

pulling the locking chord tight after the locking chord is passed through all of the loop pairs; and tying another end of the locking chord to the terminal loop pair.

2. The method of claim 1 wherein both pairs of laterally spaced opposing loops are attached to a textile material.

3. The method of claim 2 wherein said textile material is one of a receptacle and a parachute section.

4. The method of claim 2 wherein said textile material is one of at least one sub-tent and a least one bag section.

* * * * *